US006180194B1

(12) United States Patent
Liang

(10) Patent No.: US 6,180,194 B1
(45) Date of Patent: Jan. 30, 2001

(54) ARTIFICIAL CHRISTMAS TREE

(76) Inventor: Hwa-Dong Liang, No. 28-2, Lane 161, Sec.1, Tunhwa South Road Taipei (TW)

( * ) Notice: Under 35 U.S.C. 154(b), the term of this patent shall be extended for 0 days.

(21) Appl. No.: 09/317,268

(22) Filed: May 24, 1999

(51) Int. Cl.[7] ..... A41G 1/00
(52) U.S. Cl. ..... 428/19; 428/18; 428/20
(58) Field of Search ..... 428/17, 18, 19, 428/15, 12, 20; 156/61

(56) References Cited

U.S. PATENT DOCUMENTS 994,248 * 6/1911 Crook .
2,951,303 * 9/1960 Hovlid .

* cited by examiner

*Primary Examiner*—Francis J. Lorin
*Assistant Examiner*—Wendy Boss
(74) *Attorney, Agent, or Firm*—Bacon & Thomas

(57) ABSTRACT

The leaves of an artificial Christmas tree are each formed from a length of metal having its opposite ends secured to a tree trunk and a plurality of coils formed along the length thereof and having substantially the configuration of a coiled spring. A reinforcing member may extend through the coils and separate ornaments may be individually hung on selected coils.

5 Claims, 5 Drawing Sheets

ARTIFICIAL CHRISTMAS TREE

BACKGROUND OF THE INVENTION

1. Field of the Invention

The present invention is related to a novel structure for Christmas trees, and especially to the structure of an artificial Christmas tree which can be easily manufactured and conveniently used.

2. Description of the Prior Art

Christmas is a great festival for western people, and people in the entire world nowadays also celebrate this big festival. Beside those activities of celebration held by various organizations and companies, people deck the halls in families with Christmas trees to welcome Christmas day and add joyful air to it. Christmas trees can be divided into two kinds, one directs to the real trees decorated with various decorations and LED lamp sets; the other directs to the artificial decorated trees taking the places of real trees which are gradually more and more difficult to obtain year by year. And artificial decorated trees used as Christmas trees are gradually popularized.

Conventional artificial Christmas trees (please refer to FIGS. 1 and 2) each is comprised mainly of a base A, a trunk B and a lot of branches C. Wherein, the branches C each is made by assembling plastic leaves E on a stem D and is secured individually on the trunk B. When the branches C are assembled on the trunk B, they are inclined downwardly. Hence when users put LED lamp sets F and decorations G thereon, the LED lamp sets F can only be wrapped around smoothly by folding of the branches C, while the decorations G must be hung by bending the branches C. However, bending or folding of the branches C for fixing the LED lamp sets F and the decorations G endues the Christmas trees with the following disadvantages:

1. The branches C of the Christmas trees are mounted together with the plastic leaves E when the stems D are twisted for fixing the plastic leaves E. The plastic leaves E are elongated and flat, they shall be equidistantly fixed on each stems D to form bunches. After fixing, the plastic leaves E are trimmed; then the stems D are fixed on the trunk B. Manufacturing of such branches C not only is bothersome and time consuming, but also is resource wasting by the fact that the debris resulted from trimming after fixing of the plastic leaves E are not useful.
2. Fixing of the stems D on the trunk B by twisting of the stems D is subjected to dropping of lot of plastic leaves E and is bad for environment neatness. And the plastic leaves E are subjected to deformation by pressing or collision during packaging and shipping.
3. When the LED lamp sets F and the decorations G are hung on a Christmas tree and are adjusted for positioning, the stems D are supposed to be bent. However, amount of the LED lamp sets F and the decorations G and their locations of fixing are large, bending of a plurality of stems D will adversely influence the aesthetic appearance of the whole Christmas tree.
4. When in adjustment of the LED lamp sets F and the decorations G hung on a Christmas tree, they shall be in the first place taken down from the branches C. Thereafter, they are fixed on different branches C. Not only such a mode of adjustment is bothersome, but also the plastic leaves E are subjected to dropping when the branches C are repeatedly bent and repeatedly recover.
5. Such a Christmas tree is extremely time and man work consuming in assembling due to the bothersome procedure of manufacturing thereof. Therefore, price of them is high.

SUMMARY OF THE INVENTION

In view of the disadvantages resided in the conventional Christmas trees, the inventor of the present invention provides a novel structure for Christmas trees to get rid of the defects of the conventional Christmas trees after study, tests and continuous improvement based upon his professional and practical experience of years in designing and manufacturing the same kind of products.

Particularly, the structure of each of the Christmas trees of the present invention is like this, a lot of leaves thereon are formed by circling of metallic spring like coils and are used for direct hanging of the LED lamp sets which are prevented from dropping. The decorations on the Christmas tree can also be securely hung on the leaves. And an object of hanging the decorations in positions without bending the leaves can be achieved.

The primary object of the present invention is to provide a novel structure for Christmas trees made of metal. It can not only enhance the strength of the structure, but also prevent the Christmas trees from deformation during packaging and shipping. The leaves of the Christmas trees are made from spring like coils providing only slight elasticity; hence various sizes of leaves formed can be prevented from deformation as well as damage. And by providing the spring like coils, the decorations can be conveniently adjusted in hanging and can be surely hung at desired locations. This can solve the defects resided in hanging of the conventional Christmas trees. Such a Christmas tree not only is structurally simple and tough, but also can largely simplify the process of production and reduce the cost of production, and thus provides a practical as well as economic structure of Christmas tree.

The present invention will be apparent after reading the detailed description of the preferred embodiments thereof in reference to the accompanying drawings.

DETAILED DESCRIPTION OF THE PREFERRED EMBODIMENT

Figure 1:
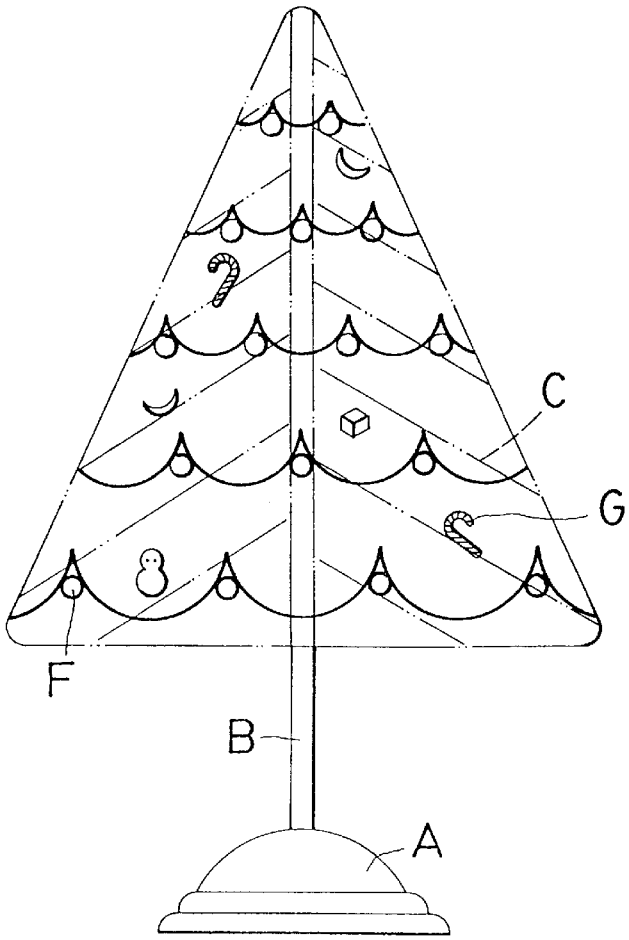
Fig. 1 PRIOR ART
FIG. 1 is a perspective view showing the appearance of a conventional Christmas tree.
Figure 2:
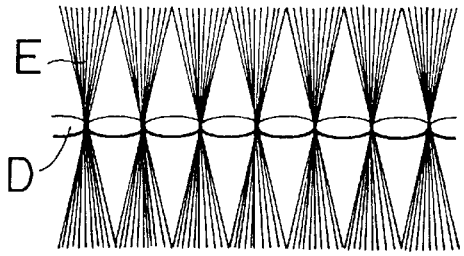
Fig. 2 PRIOR ART
FIG. 2 is a schematic plane view of the conventional Christmas tree shown in FIG. 1.
Figure 3:
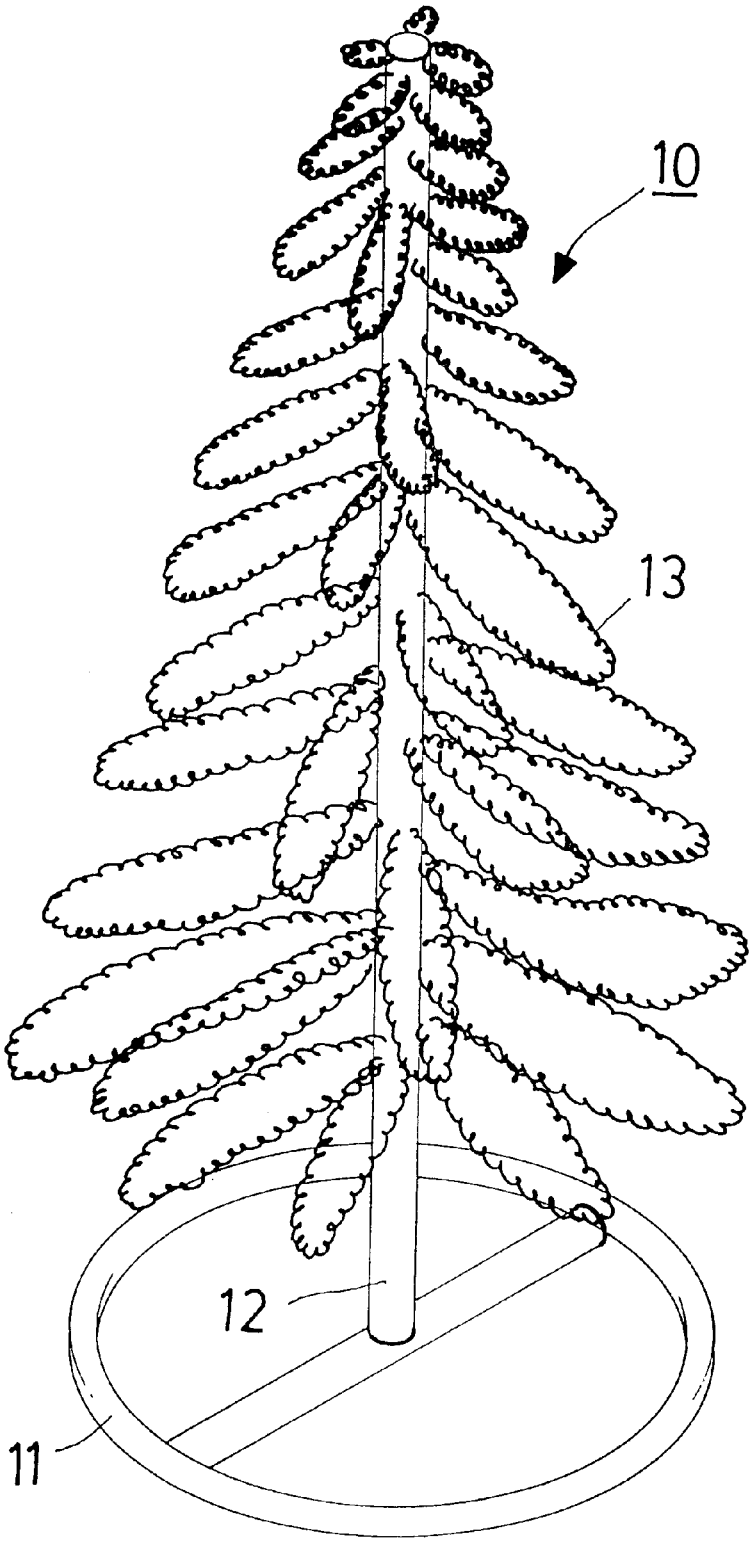
FIG. 3 is a perspective view of the present invention.

Referring to FIG. 3 being a perspective view of the present invention, which shows that a Christmas tree of the present invention is comprised mainly of a seat 11, a trunk 12 and a lot of leaves 13. Wherein, the trunk 12 is mounted at the center of the seat 11 and is provided with the leaves 13 from the top to a lower level thereon. The leaves 13 are made by circling of spring like coils formed along the length of an elongate member between the opposite ends of the member; the two opposite ends of each elongate member are welded to the trunk 12 at an appropriate location thereon. The leaves 13 each has a smaller area on the top and gradually enlarges downwardly to have a larger area at the lower level of the trunk 11, so that the Christmas tree as a whole is in the shape of a cone.

Figure 4:
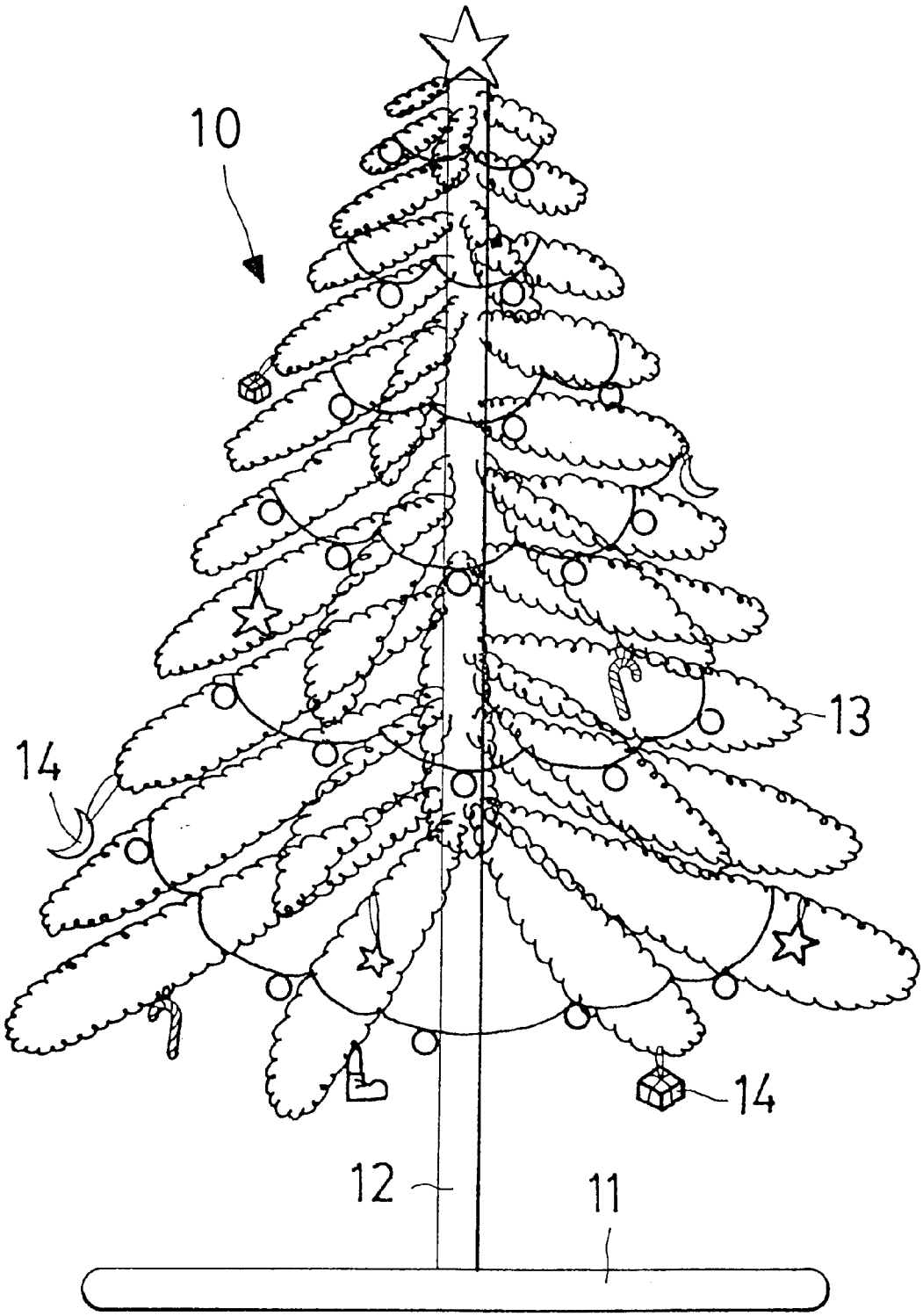
FIG. 4 is a schematic elevational plane view showing use of the present invention.

The seat 11 and the trunk 12 are made of material having appropriate mass or weight for the purpose that the leaves 13 and decorations 14 obtain adequate supporting force (as shown in FIG. 4). The leaves 13 are made of metal to form spring like coils and are processed by paint spraying, varnish baking or electric plating to prevent from rusting, and to increase smoothness and brightness. Thereby, a structurally simple, good looking and tough Christmas tree is provided.

Figure 5:
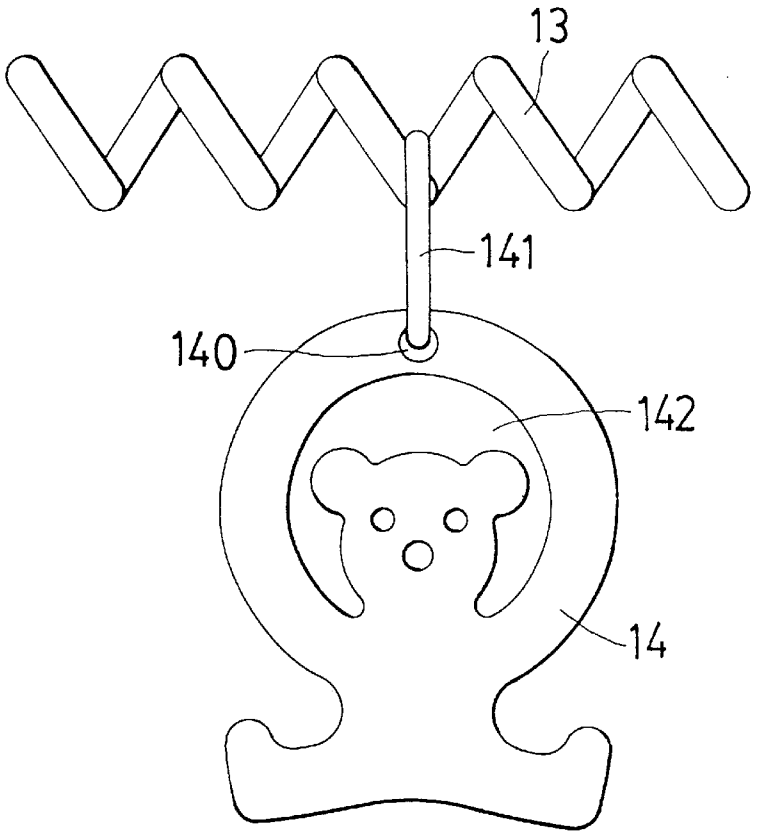
FIG. 5 is a schematic view showing combination of a leaf with a decoration article of the present invention.
Figure 8:
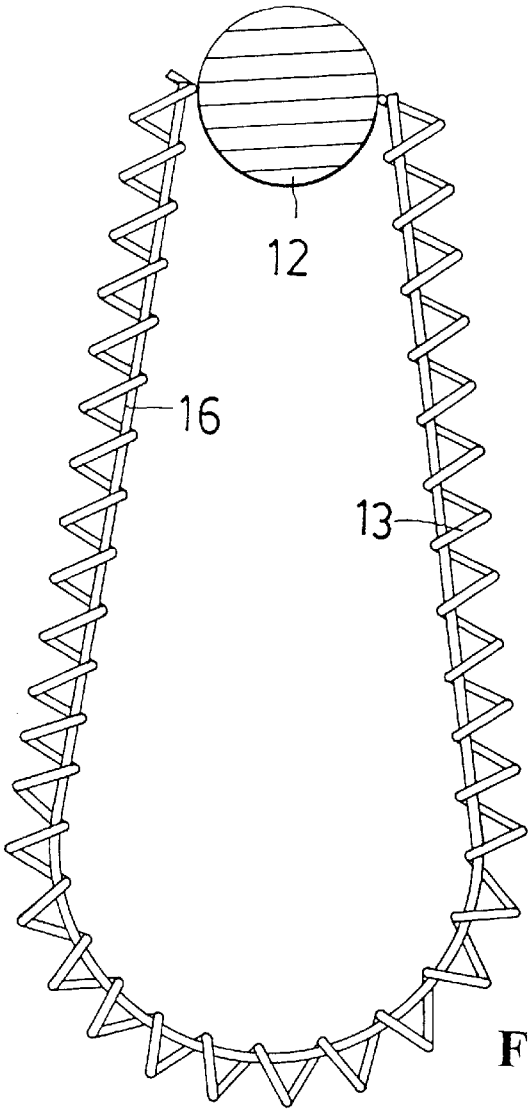
FIG. 8 is a variation of FIG. 7.
Figure 7:
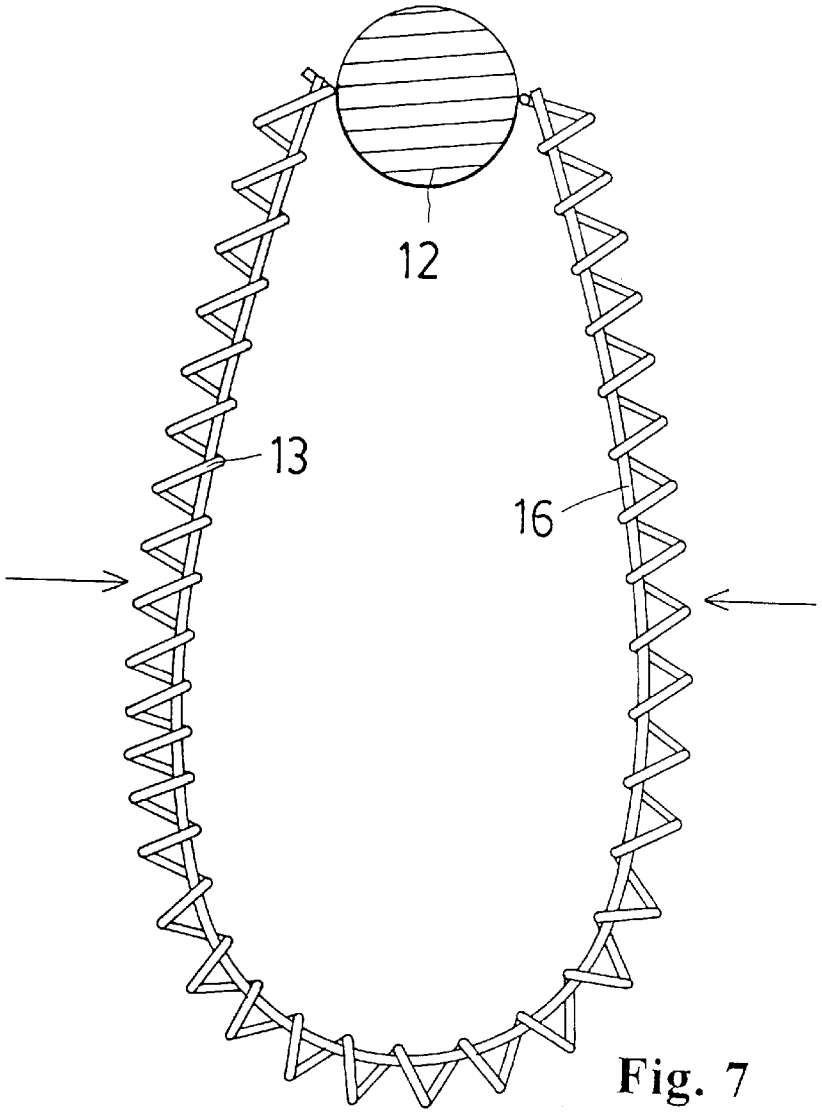
FIG. 7 shows a further embodiment of a leaf of the present invention.

The decorations 14 are hung on the leaves 13 by means of lines 141 extended through holes 140 provided on the decorations 14 (as shown in FIG. 5). Or the leaves 13 can be extended directly into the holes 140 or central bores 142 of the decorations 14. Then the two ends of the leaves 13 are fixed on the trunk 12, so that the decorations 14 can move freely on the leaves 13 to adjust the positions thereof. In this way, aesthetic appearance of the Christmas tree can be better.

Figure 6:
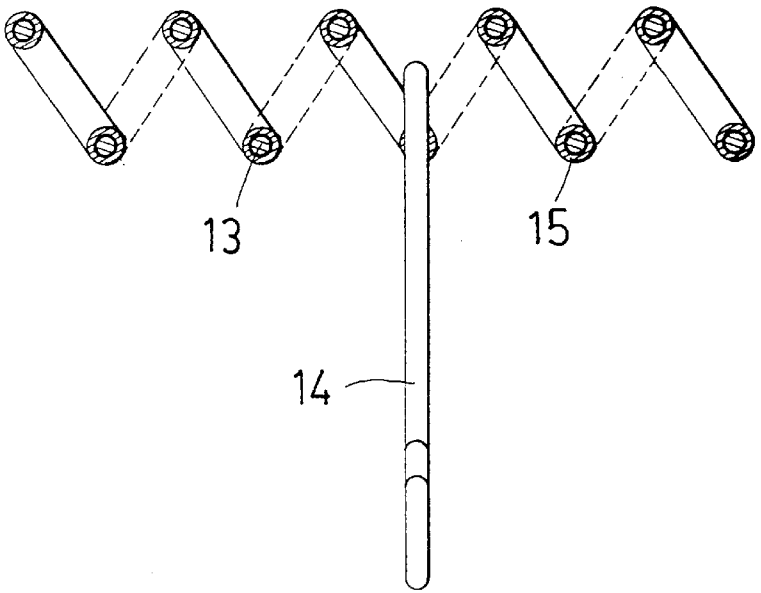
FIG. 6 shows another embodiment of a leaf of the present invention.

Moreover, the leaves 13 are made of metallic material, it can not only be processed by paint spraying, varnish baking or electric plating to prevent from rusting and to increase smoothness and brightness; but can also be enveloped with an insulating layer 15 (as shown in FIG. 6). Therefore, when LED lamp sets are hung thereon, they form an excellent insulation state on the leaves 13 for preventing electric conducting. The spring like coils of the leaves 13 can be extended therethrough with reinforcing members 16. The reinforcing members 16 can increase the structural strength of the leaves 13 for hanging heavier decorations 14, and can afford variation of the leaves 13 in width and orientation suiting viewing in different angular positions of a user. The reinforcing members 16 can be made to have various colors to increase aesthetic appearance of the Christmas tree. Therefore, a colorful Christmas tree with good visual effect can be obtained.

Accordingly, the Christmas tree of the present invention has the following advantages:

1. The Christmas tree is made of metallic material, of which the structural strength can be increased, convenience in packaging and shipping thereof can be attained. Thereby, deformation in packaging and shipping thereof can be prevented.
2. The leaves of the Christmas tree are in the form of spring like coils having only slight elasticity, hence various sizes of the leaves formed can be prevented from deformation as well as damage. And by providing the spring like coils, the decorations can be conveniently adjusted in hanging and can be surely hung at desired locations. This can solve the defects resided in hanging of the conventional Christmas trees.
3. Such a Christmas tree not only is structurally simple and tough, but also can largely simplify the process of production and reduce the cost of production, and thus provides a practical as well as economic structure of Christmas tree.
4. The leaves are processed by paint spraying, varnish baking or electric plating to prevent from rusting and to increase smoothness and brightness.
5. The spring like coils of the leaves can be extended therethrough with reinforcing members to increase the structural strength of the leaves for hanging heavier decorations, and can afford variation of the leaves in width and orientation.
6. The reinforcing members can be made to have various colors to increase aesthetic appearance of the Christmas tree.
7. The leaves each is enveloped with an insulating layer. Therefore, when LED lamp sets are hung thereon, an excellent insulation state is formed on the leaves for preventing electric conducting.

The drawings attached are only for illustrating a preferred embodiment of the present invention, and not for giving any limitation to the scope of the present invention. It will be apparent to those skilled in this art that various equivalent modifications or changes can be made to the elements of the present invention without departing from the spirit, scope and characteristic of this invention. Accordingly, all such modifications and changes also fall within the scope of the appended claims and are intended to form part of this invention.

Having thus described the technical structure of my invention with practicability and improvement, what I claim as new and desire to be secured by Letters Patent of the United States are:

1. An artificial Christmas tree comprising:

a) a seat;

b) a trunk having a bottom end supported on the seat, the trunk extending upwardly from the seat and terminating in a top end;

c) a plurality of leaves of varying sizes secured along the trunk, wherein the leaves progressively increase in size from the top end toward the bottom end of the trunk, thereby collectively defining a substantially conical configuration; and d) each leaf being formed from an elongate member having a pair of opposite ends and a plurality of open coils between the opposite ends, the coils collectively defining a substantially coiled spring configuration, and the opposite ends being secured to the trunk.

2. The tree of claim 1, wherein each leaf includes a coating thereon for preserving and enhancing its appearance.

3. An artificial Christmas tree comprising:

a) a seat;

b) a trunk having a bottom end supported on the seat, the trunk extending upwardly from the seat and terminating in a top end;

c) a plurality of leaves of varying sizes secured along the trunk, wherein the leaves progressively increase in size from the top end toward the bottom end of the trunk, thereby collectively defining a substantially conical configuration;

d) each leaf being formed from an elongate member having a pair of opposite ends and a plurality of coils between the opposite ends, the coils collectively defining a substantially coiled spring configuration, and the opposite ends being secured to the trunk; and e) wherein each elongate member is formed of metal and the coils impart elasticity to the member for preventing deformation and permitting each leaf to be adjusted in configuration.

4. An artificial Christmas tree comprising:

a) a seat;

b) a trunk having a bottom end supported on the seat, the trunk extending upwardly from the seat and terminating in a top end;

c) a plurality of leaves of varying sizes secured along the trunk, wherein the leaves progressively increase in size from the top end toward the bottom end of the trunk, thereby collectively defining a substantially conical configuration;

d) each leaf being formed from an elongate member having a pair of opposite ends and a plurality of coils between the opposite ends, the coils collectively defining a substantially coiled spring configuration, and the opposite ends being secured to the trunk; and e) a reinforcing member extending through the coils of each leaf.

5. The tree of claim 4, wherein each reinforcing member includes a color coating thereon.

* * * * *